United States Patent [19]

Menssen

[11] 4,096,951

[45] Jun. 27, 1978

[54] CAMPING UTILITY STAND

[75] Inventor: Leroy K. Menssen, Estherville, Iowa

[73] Assignee: The Raymond Lee Organization, Inc., New York, N.Y. ; a part interest

[21] Appl. No.: 796,228

[22] Filed: May 12, 1977

[51] Int. Cl.[2] ..... A47K 1/04; A47K 1/05

[52] U.S. Cl. ..... 211/207; 4/170; 248/156; 211/190; 211/71

[58] Field of Search ..... 211/107, 112, 207, 195, 211/71, 174, 190; 248/125, 122, 149, 150, 153, 156; 126/25 A, 25 R, 30, 29, 59; 108/116, 134; 4/167-170, 187

[56] References Cited

U.S. PATENT DOCUMENTS

| | | | |
|---|---|---|---|
| 461,586 | 10/1891 | Matzenauer | 248/156 |
| 1,173,036 | 2/1916 | Robidoux | 211/71 X |
| 1,799,079 | 3/1931 | Bemis | 248/146 |
| 1,834,144 | 12/1931 | Coderre et al. | 211/71 X |
| 1,984,602 | 12/1934 | Snyder | 248/240.3 |
| 2,501,895 | 3/1950 | Gayle | 248/156 |
| 2,977,953 | 4/1961 | Dowdy | 126/30 |
| 3,102,638 | 9/1963 | Saunders | 211/71 |
| 3,199,818 | 8/1965 | Ahara | 248/156 |
| 3,285,554 | 11/1966 | Voelkerding | 248/156 X |
| 3,995,796 | 12/1976 | Kline | 248/156 |

FOREIGN PATENT DOCUMENTS

| | | | |
|---|---|---|---|
| 1,091,957 | 1/1954 | France | 108/134 |

*Primary Examiner*—James T. McCall
*Assistant Examiner*—Terrell P. Lewis
*Attorney, Agent, or Firm*—Daniel Jay Tick

[57] ABSTRACT

A main rod has a point at a first end for piercing supporting ground and a coaxial bore formed in a spaced opposite second end. A square loop rod has spaced opposite first and second ends with first and second cross rods at said ends, respectively. A grating at the first end of the square loop rod supports a bar of soap. The remainder of the square loop rod supports towels. A circular rod extends beyond the first end of the square loop rod for supporting a wash pan. A generally V-shaped support rod is pivotally mounted on the first cross rod. The square loop rod is pivotally mounted on the main rod in an adjustable manner whereby the square loop rod is positionable at a desired point along the length of the main rod from a position perpendicular to the main rod to a position next-adjacent the main rod. A plurality of spaced protruding members on the main rod support the end of the support rod farthest from the square loop rod to maintain the square loop rod perpendicular to the main rod at different points therealong.

3 Claims, 4 Drawing Figures

CAMPING UTILITY STAND

BACKGROUND OF THE INVENTION

The present invention relates to a camping utility stand.

Objects of the invention are to provide a camping utility stand of simple structure, which is inexpensive in manufacture, used with facility and convenience, installed wherever desired at any convenient camping site, assembled with facility, convenience and rapidity, collapsed or folded with facility, convenience and rapidity to a small volume, and functions efficiently, effectively and reliably to support a bar of soap, towels, a wash pan, and a lantern at desired distances above the ground.

BRIEF DESCRIPTION OF THE DRAWINGS

In order that the invention may be readily carried into effect, it will now be described with reference to the accompanying drawing, wherein.

DETAILED DESCRIPTION OF THE INVENTION

Figure 1:
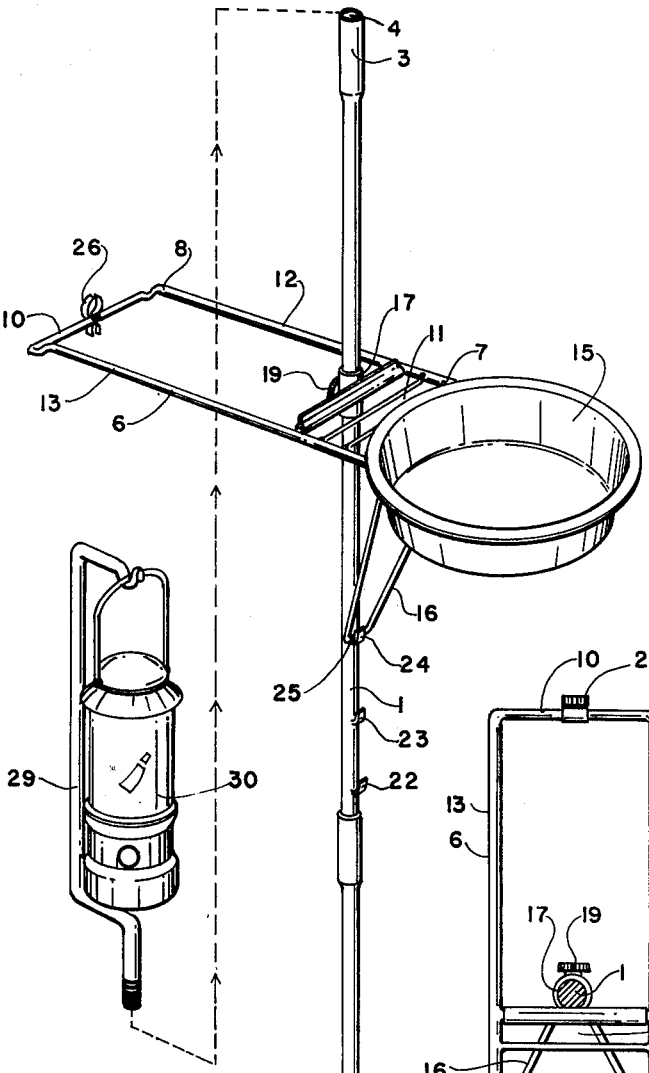
FIG. 1 is a perspective view of an embodiment of the camping utility stand of the invention in assembled condition.

The camping utility stand of the invention comprises a main rod 1 (FIGS. 1 to 3) having spaced opposite first and second ends 2 and 3 (FIG. 1). The first end 2 has a point thereon for piercing supporting ground and the second end 3 has a coaxial bore 4 formed therein (FIG. 1). The main rod 1 is preferably provided in two or three parts, for more compact storage, when not in use. Each part has a coaxial bore formed at one end thereof to accommodate the part supported thereby in a coaxial manner.

An anchor member 5 is affixed to the main rod 1 in the area of the first end 2 thereof and surrounds the main rod for applying pressure to urge said main rod into the ground. The anchor member 5, shown in FIG. 1, is of substantially frustoconical configuration and is positioned with its larger diameter base above its smaller diameter base so that the user may apply pressure with his or her foot to force the main rod 1 in an axial direction into supporting ground.

Figure 2:
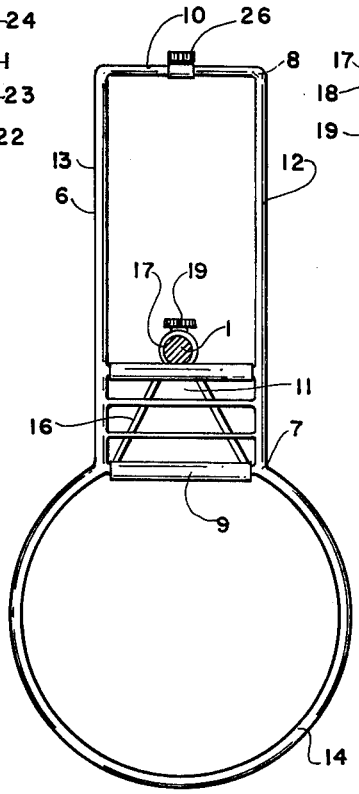
FIG. 2 is a top view, on an enlarged scale, of an embodiment of the square loop rod of the camp utility stand of the invention, as mounted on the main rod thereof.

A substantially square loop rod 6 (FIGS. 1 to 3) has spaced opposite first and second ends 7 and 8 (FIGS. 1 and 2). First and second cross rods 9 and 10 are provided at the first and second ends 7 and 8, respectively (FIG. 2). A grating 11 is provided at the first end 7 of the square loop rod 6 for supporting a bar of soap. The grating 11 consists of cross rods of smaller diameter than the first and second cross rods 9 and 10.

The remainder 12 and 13 of the square loop rod 6 (FIGS. 1 and 2) supports towels. A circular rod 14 (FIGS. 2 and 3) extends beyond the first end 7 of the square loop rod 6 and functions to support a wash pan

Figure 3:
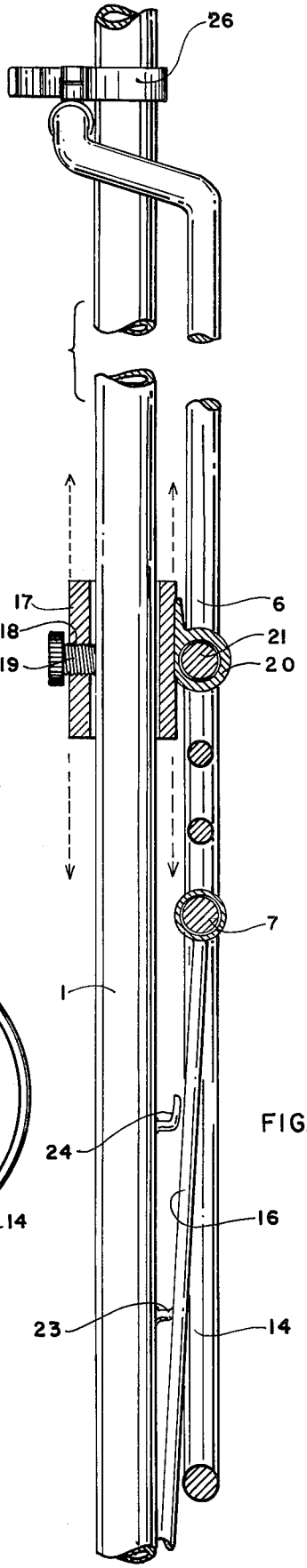
FIG. 3 is a view, on an enlarged scale, partly in section, of the main rod and the square loop rod in folded condition.

15, as shown in FIG. 1. A generally V-shaped support rod 16 (FIGS. 1 to 3) is pivotally mounted on the first cross rod 9. A mounting device pivotally mounts the square loop rod 6 on the main rod 1 in an adjustable manner, as shown in FIGS. 1 to 3. The mounting device mounts the square loop rod 6 in a manner whereby the square loop rod is positionable at a desired point along the length of the main rod 1 from a position substantially perpendicular to the main rod, as shown in FIGS. 1 and 2, to a position substantially next-adjacent said main rod, as shown in FIG. 3. The mounting device comprises a sleeve 17 slidably mounted on the main rod 1 for movement in axial directions of said main rod. As shown in FIG. 3, a bore 18 is radially provided in the sleeve 17 and is internally threaded. A knurled-headed bolt-type tightening member 19 is threadedly coupled in the bore 18 of the sleeve 17 and is used to releasably secure the sleeve in any desired position along the main rod 1. A closed loop type member 20 extends from the sleeve 17 diametrically opposite the bolt-type member 19 and the square loop rod 6 is pivotally mounted therein via an intermediate cross rod 21 of said square loop rod, as shown in FIG. 3.

A plurality of spaced protruding members 22, 23 and 24 are provided on the main rod 1 for supporting the end 25 of the support rod 16 farthest from the square loop rod 6 (FIG. 1) to maintain said square loop rod substantially perpendicular to said main rod at different points therealong. As clearly shown in FIG. 3, each of the protruding members is of generally L shape so that the end 25 of the support rod 16 is releasably secured therein.

Figure 4:
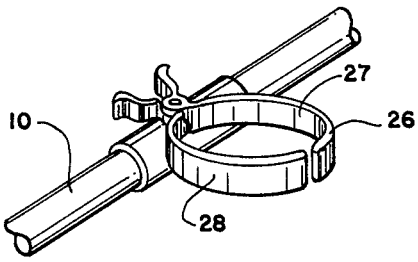
FIG. 4 is a view, on an enlarged scale, of an embodiment of the locking device of the camping utility stand of the invention.

A locking member 26 is affixed to the second cross rod 10 of the square loop rod 6 for releasably clamping the square loop rod to the main rod 1 when said main rod and said square loop rod are in next-adjacent positions, as shown in FIG. 3, due to the utility stand of the invention being folded for storage or transportation. The locking member 26 comprises a clamping device having a pair of pivotally mounted semiannular arms which are manually controlled to grasp the main rod 1, as shown in FIG. 3, when the camping utility stand of the invention is folded. To release the locking member 26, the clamping arms 27 and 28 (FIG. 4) are manually spread apart.

A lantern hook 29 (FIG. 1) is removably supported coaxially in the bore formed in the second end 3 of the main rod 1 for supporting a lantern 30 (FIG. 1).

While the invention has been described by means of a specific example and in a specific embodiment, I do not wish to be limited thereto, for obvious modifications will occur to those skilled in the art without departing from the spirit and scope of the invention.

I claim:

1. A camping utility stand, comprising a main rod having spaced opposite first and second ends, said first end having a point thereon for piercing supporting ground and said second end having a coaxial bore formed therein;

an anchor member affixed to the main rod in the area of the first end thereof and surrounding said main rod for applying pressure to urge the main rod into the ground;

a substantially square loop rod having spaced opposite first and second ends with first and second cross rods at the first and second ends, respectively, and a grating at the first end of said square loop rod for supporting a bar of soap, the remainder of said square loop rod supporting towels, a circular rod extending beyond the first end of the square loop rod for supporting a wash pan, and a generally V-shaped support rod pivotally mounted on the first cross rod;

mounting means pivotally mounting the square loop rod on the main rod in an adjustable manner whereby said square loop rod is positionable at a desired point along the length of the main rod from a position substantially perpendicular to said main rod to a position substantially next-adjacent said main rod; and a plurality of spaced protruding members on the main rod for supporting the end of the support rod farthest from the square loop rod to maintain said square loop rod substantially perpendicular to said main rod at different points therealong.

2. A camping utility stand as claimed in claim 1, further comprising a locking member affixed to the second cross rod of the square loop rod for releasably clamping said square loop rod to said main rod in next-adjacent position thereto.

3. A camping utility stand as claimed in claim 1, further comprising a lantern hook removably supported coaxially in the bore formed in the second end of the main rod.

* * * * *